US007836918B1

(12) United States Patent
Osborne

(10) Patent No.: US 7,836,918 B1
(45) Date of Patent: Nov. 23, 2010

(54) PROCESS FOR IMPARTING HIGH STRETCH, RECOVERY AND MODULUS INTO A WOVEN FABRIC

(75) Inventor: Eva Osborne, New Smyrna Beach, FL (US)

(73) Assignee: Paradox LLC, Edgewater, FL (US)

( * ) Notice: Subject to any disclaimer, the term of this patent is extended or adjusted under 35 U.S.C. 154(b) by 0 days.

(21) Appl. No.: 12/591,373

(22) Filed: Nov. 18, 2009

(51) Int. Cl.
*D03D 15/08* (2006.01)
*D03D 15/02* (2006.01)
*D03D 25/00* (2006.01)

(52) U.S. Cl. ..... 139/421; 139/422; 139/11; 139/383 R

(58) Field of Classification Search ..... 139/59–65, 139/78, 291 R, 317–319, 327, 387 R, 388, 139/389, 390, 332, 333, 408, 410, 413, 418, 139/420 R, 421, 422, 426 R, 420 A
See application file for complete search history.

(56) References Cited

U.S. PATENT DOCUMENTS 2,998,030 A * 8/1961 Koppelman et al. ..... 139/387 R
3,695,306 A * 10/1972 Kimura et al. ..... 139/196.2
3,750,716 A * 8/1973 Kimura et al. ..... 139/439
3,809,131 A * 5/1974 Kimura et al. ..... 139/196.2
4,410,015 A * 10/1983 Koller et al. ..... 139/383 AA
5,058,329 A * 10/1991 Love et al. ..... 451/54
5,396,932 A * 3/1995 Homma et al. ..... 139/420 A
6,095,449 A * 8/2000 Gallo et al. ..... 242/365.4
6,145,551 A * 11/2000 Jayaraman et al. ..... 139/387 R
6,315,009 B1 * 11/2001 Jayaraman et al. ..... 139/387 R
6,349,750 B1 * 2/2002 Fujiwara ..... 139/384 R
6,389,850 B1 * 5/2002 Fujiwara ..... 66/176
6,883,555 B1 * 4/2005 Speich ..... 139/294

* cited by examiner

*Primary Examiner*—Bobby H Muromoto, Jr.

(57) ABSTRACT

A process for imparting a variety of ranges in modulus, stretch and recovery characteristics into an elastomeric fill yarn and a rigid warp yarn stretch woven fabric. The high stretch/recovery properties, in the fill direction, is achieved by using a plurality of successive fabric forming operations, resulting in incremental stretch capacity from each successive operation. The fabric exhibits high stretch/recovery properties in the fill direction and rigid or extremely low stretch properties in the warp direction.

1 Claim, 4 Drawing Sheets

PROCESS FOR IMPARTING HIGH STRETCH, RECOVERY AND MODULUS INTO A WOVEN FABRIC

BACKGROUND OF THE INVENTION

In general, fabrics with weft woven stretch are produced by inserting elastomeric yarns, crimped yarns, or high twist spun yarns into the fill direction of a fabric while weaving with a rigid warp yarn. These fabrics are subsequently subjected to fabric finishing processes that produce stretch characteristics. These desirable stretch performance fabrics are being produced in a variety of ways by exploiting the mechanics of the textile machinery as well as the structural properties of the fibers and yarns.

U.S. Pat. No. 5,858,885 to Hamilton et al (1999) builds stretch into woven fabrics with partially oriented elastomeric core-in-sheath yarns (POY). The stretched fabric is heat set in the stretched position, then immersed in an aqueous bath which results in a stretch capacity or 18% to 45% with dimensions similar to the loom state fabric.

U.S. Pat. No. 3,357,076 to Greenwald et al (1967) lists 3 processes for imparting weft stretch to woven fabrics using undrawn yarn. 1) the fabric is woven at 55" loom-state then relaxes to 43" and heat set in a relaxed position resulting in a 40% stretch 2) the fabric was woven to 110" loom-state, relaxed to 48" then heat set resulting in 215% stretch. 3) the fabric was woven to 110" loom-state and heat set in the stretched position resulting in a 10% stretch.

U.S. Pat. No. 3,655,327 to Rollins (1972) involves a stepwise fabric process that increases the take up in the weft direction by increasing and maintaining a higher than normal warp tension throughout the weaving and finishing process. The increased weft take up produces a fill wise crimp that is heat set and results in a 20% to 35% mechanical stretch in the fill direction.

U.S. Pat. No. 3,077,655 to Runton (1963) establishes a weft stretch of 10% to 25% by weaving with open low fabric count weaves containing high twist wool yarns in the warp and fill. During finishing the yarns are compacted by alternating compaction and release with the use of a reducing agent and agitation. The shrinkage of the fabric imparts stretch by alternating compaction and release; thereby using the inherent felting ability of wool fibers through entanglement of the scale structure.

U.S. Pat. No. 2,765,513 (1956) and No. 2,765,514 (1954) both to Waton, create warp stretch woven fabric with mechanical compaction the warp direction. By feeding the fabric at a speed and co-efficient of friction differential between two nip rolls with the use of a blade, stretch is imparted by pushing the weft yarns closer together and heat setting. This essentially increases the warp take up giving the fabric elastic characteristics of 10% or greater.

It is the intent of this endeavor to produce additional performance capability in weft stretch woven fabrics that exhibits a high degree of stretch with a controlled modulus for compression and good recovery.

SUMMARY OF THE INVENTION

The object of this invention is to provide a process for producing woven stretch fabric that maximizes the available weft stretch, reduces the weft growth, results in good recovery while maintaining control over the weft modulus by integrating existing yarn structures, weave designs and finishing operations.

The present invention includes the stepwise process of weaving a fabric with non-elastomeric warp yarns with elastomeric weft yarns under some specified tensions in both directions. After weft insertion the fabric is allowed to a partial relaxation. The subsequent fabric is exposed to steam, open width wash, and drying under a tension free operations. This is followed by heat setting in a tensionless compression operation such as decate, Biella™, calendaring, or hot head press.

The fill yarns used in the embodiment of this invention are core-in-sheath composite yarn structures, however the invention is not restricted to this yarn structure. The elastomeric fibers are selected from yarn counts of 40 denier to 300 denier. The total yarn count of the core is not restricted to a number of filaments. The non-elastic or rigid sheath yarns are formed from any non elastic natural or man-made fiber. Any thermoplastic yarns used for the sheath of the core yarns will be made of Partially Oriented Synthetic Crystalline Organic Fiber (POY). The sheath is restricted to neither yarn structure nor yarn count. However, the denier of the elastomeric will control the recovery and modulus of the designed fabric.

The warp yarns are formed from any non elastic natural or man-made fiber. The warp yarns are restricted to neither yarn structure nor yarn count. The warped yarns are treated with coning oil. The end count is set such that the distance between the warp yarns will fully jam to a width equal to the desired stretch.

The weave of the yarn will determine the total compacted width. Any basic weave pattern or combination thereof may be used.

The invention shows that it is possible to produce a fabric having 90% or greater stretch and 90% or greater recovery in the fill direction by means of applying a specified tension on the elastomeric fill yarn while inserting the yarn into the weave shed. The spacing of the warp yarns should be at a distance which creates enough space between the ends to allow for compaction of the stretched fill yarn. The chosen weave pattern will determine the maximum compaction of the warp ends via the number of floats and interlacings per pick. The loom state fabric is then subjected to a tension free steam bath and open wash. The position of the steam and wash operations in the PFP (process flow procedure) can be interchanged to create different textures. Further jamming the fabric under tensionless drying follows the wet operations. The final step in the PFP will heat set the fabric with a decate, calendar, Biella™, hot head press or similar tension free compression operation.

The invention shows that it is possible to produce a fabric having a modulus ranging from 1 to 4 in the fill direction by means of applying a specified tension on the elastomeric fill yarn by establishing the appropriate denier/modulus ratio of the elastomeric component of the fill yarn while inserting the yarn into the weave shed, spacing the warp yarns at a distance to maximize the compaction of the stretched fill yarn, creating a pattern that will maximize the compaction of the warp yarns, jamming the fabric in tension free steam, wash and drying operations. Heat setting the weave occurs with a decate, calendar, Biella™, hot head press or similar free tension compression operation.

DETAILED DESCRIPTION OF THE INVENTION

Figure 1:
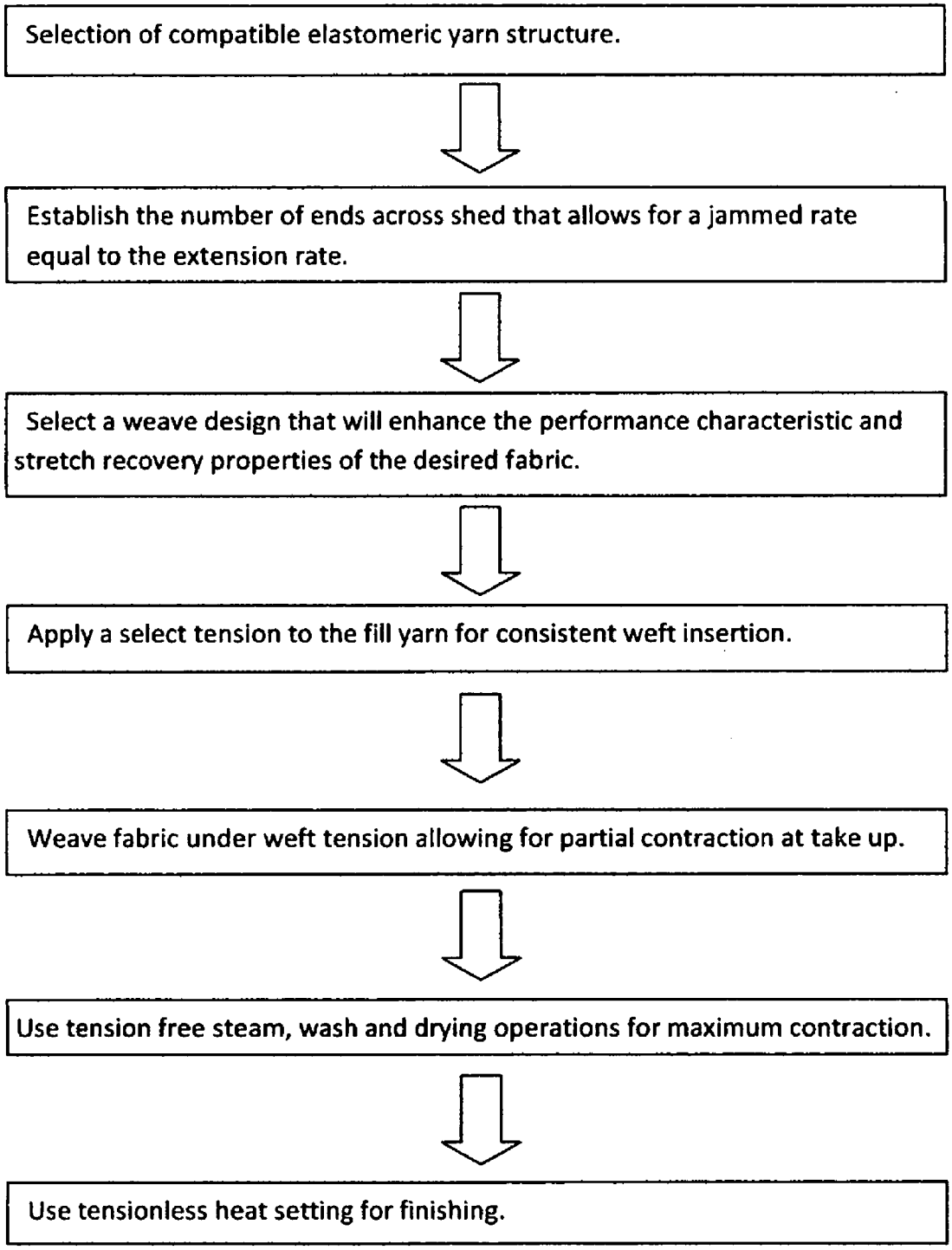
FIG. 1 Stepwise Process for Finishing

FIG. 1 is a Process Flow Sheet set forth for a generalized procedure of the stepwise operations required to produce a weft stretch woven fabric with high elasticity and an elastic modulus that insures compression. As outlined in the flow sheet the first step requires the selection of an elastomeric yarn that exhibits the stretch and modulus required for the fabric.

operations (C) further contraction occurs and the fabric exhibits greater bulk and increased coverage. The order of wet operations is important to the final appearance. Crack marks, differential shrinkage and folds will result if the steam operation does not precede the wash operation. There may be instances when the fabric is subjected to the wash process first to create folds and cracks for an aesthetic. The wet operations are followed by tension free drying (D). It is during the drying operation that complete compaction occurs resulting in a completely jammed fabric. At this point the fabric cannot shrink, contract or move together in any appreciable amount. The tension free heat set is the final operation in the PFP (E). The final finish under tensionless heat and pressure will set the yarn into place and improve the hand and appearance.

Figure 6:
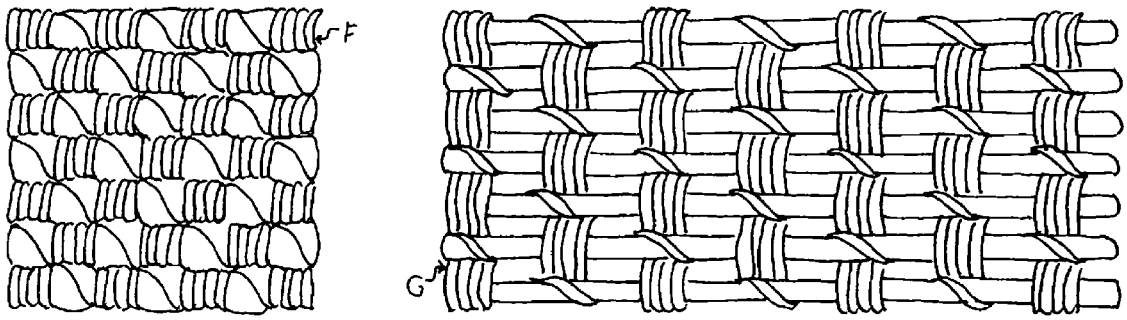
FIG. 6 Relaxed Plain Weave and 100% Weft Stretch Plain Weave

FIG. 6 shows the tensionless fabric (F) and the fabric stretched 100% (G).

The following specific examples of the embodiment of this invention are given for the purposes of illustration and should not be considered as limiting the spirit or scope of this invention.

| Yarn Description | | | Loom | | Finished | | | | |
|---|---|---|---|---|---|---|---|---|---|
| Rigid | Elastomeric | | Dimensions | | Dimensions | | Stretch | Recovery | Modulus |
| Polyester | Spandex | Weave | epi | ppi | epi | ppi | % | % | E = stress/strain |
| POY | 40D | 1:1 Plain | 42 | 60 | 52 | 64 | 90 | 90 | 3.55 |
| POY | 70D | 2:2 Twill | 42 | 60 | 82 | 68 | 138 | 90 | 2.32 |
| | | | 42 | 70 | 90 | 73 | 125 | 90 | 2.56 |
| | | | 42 | 80 | 90 | 100 | 110 | 90 | 2.88 |
| nylon POY | 126D | Crepe | 42 | 60 | 117 | 73 | 188 | 95 | 1.70 |
| | | | 42 | 70 | 120 | 73 | 176 | 95 | 1.82 |
| | | | 42 | 80 | 122 | 78 | 120 | 95 | 2.65 |
| | | 5 Shaft | | | | | | | |
| POY | 150D | Satin | 42 | 60 | 130 | 72 | 125 | 95 | 2.56 |
| | | | 42 | 70 | 133 | 72 | 111 | 95 | 2.88 |
| | | | 42 | 80 | 130 | 78 | 90 | 95 | 3.55 |

Specimen test size: 125 mm wide by 500 mm long
End point load at 2000 g

Figure 2:
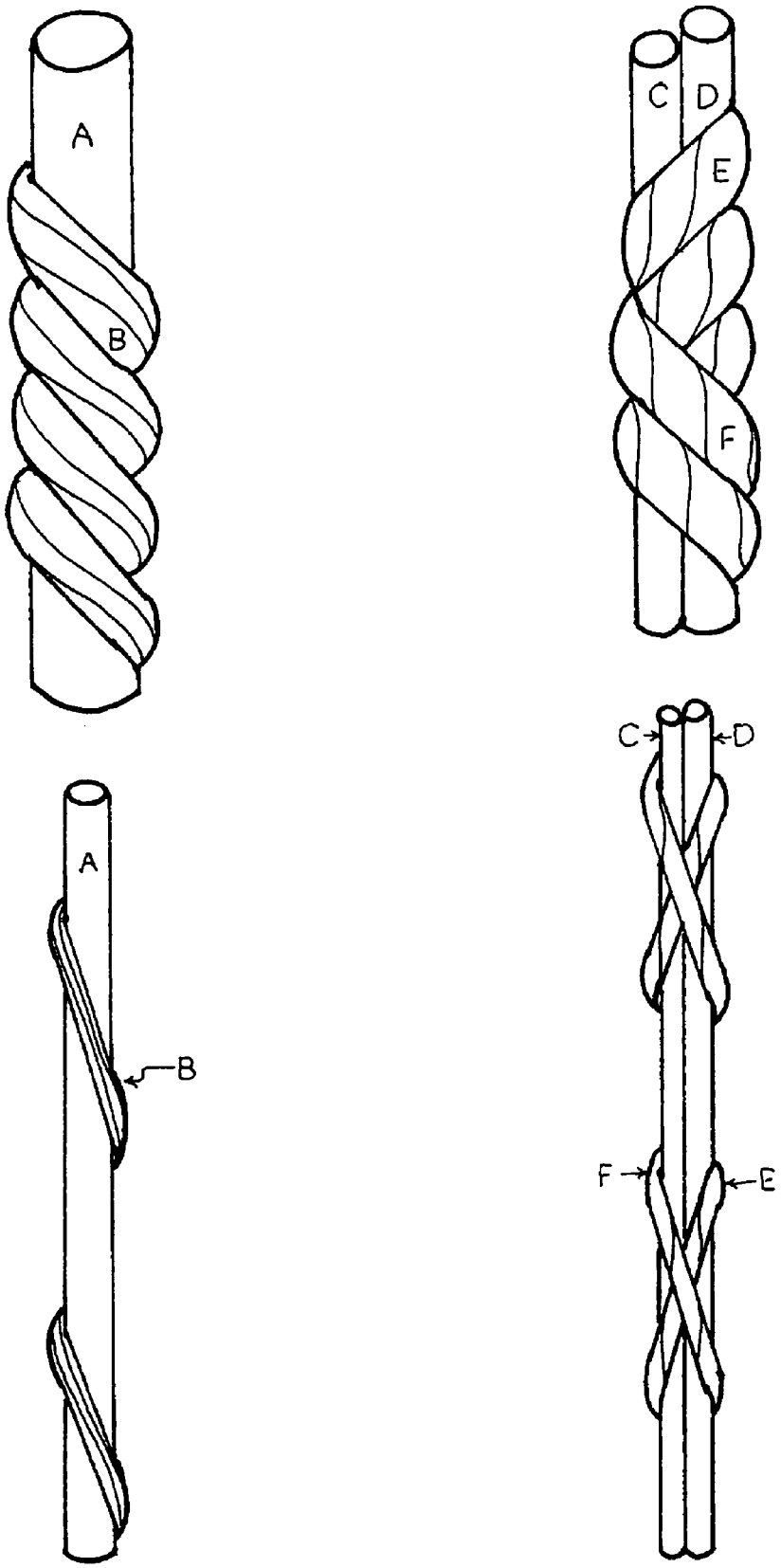
FIG. 2 Core Spun yarns in Relaxed and 100% Stretched Form

For illustration purposes FIG. 2 exhibits the maximum available stretch in two structures of core in sheath elastomeric yarns. The available stretch is dependent upon the construction of the rigid yarn in the sheath (B, E, &F). The yarn will only stretch as far as the rigid "coil" stretches out (see core A & C/D). The modulus is determined by the elastomeric core (A & CID). Predominately, the fiber content, the denier, and number of yarn filaments are the yarn characteristics which dictate the stretch and recovery properties.

Figure 3:
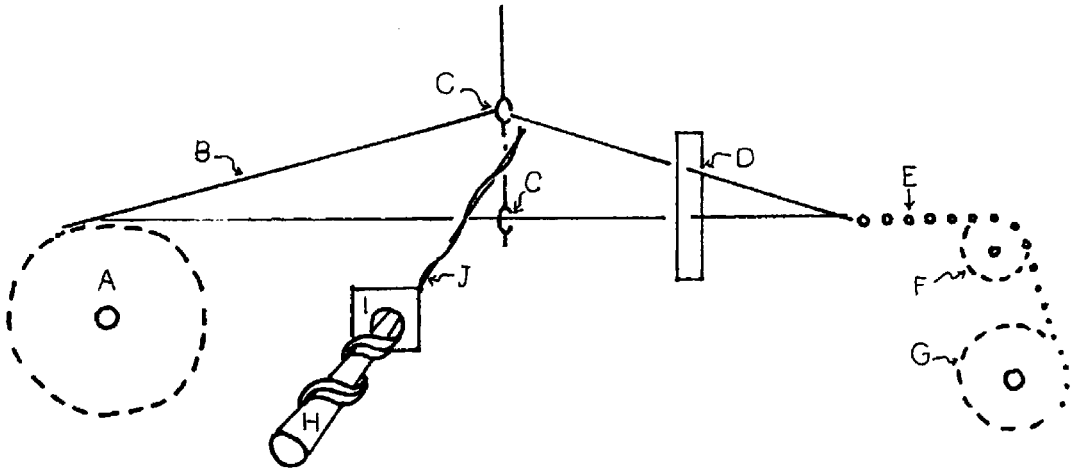
FIG. 3 Fill Yarn Placement through the Weave Shed while under tension
Figure 4:
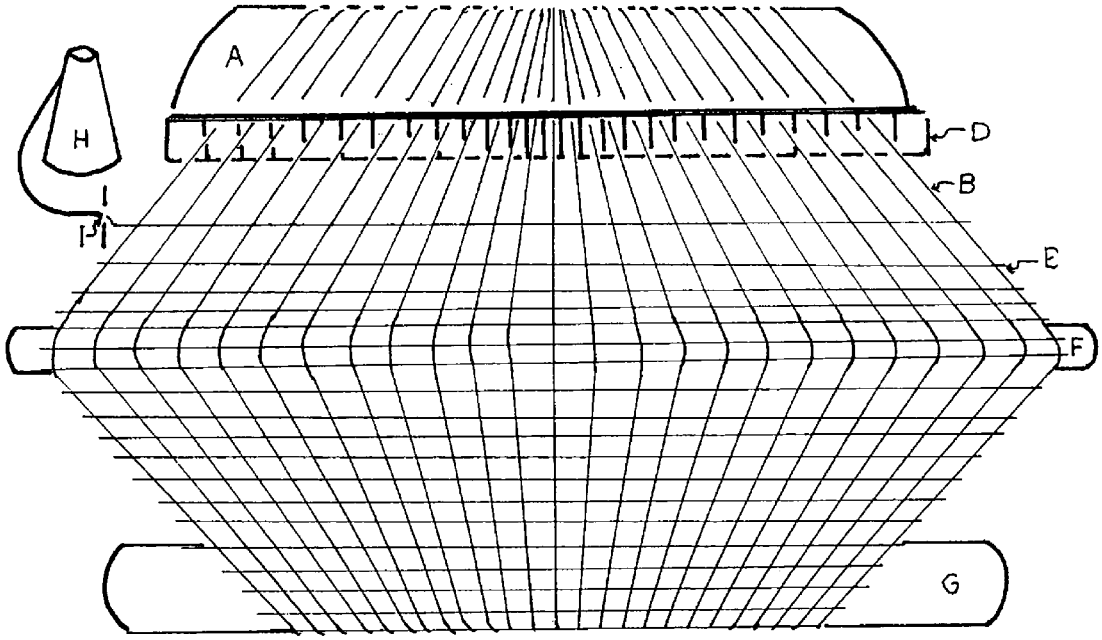
FIG. 4 Contraction of the woven fabric on the loom

In conjunction with the yarn selection the distance between the end yarns and the weave type will dictate the amount of compaction on the loom (see FIGS. 3 & 4). The selected fill yarn (H,J) is inserted into the shed (C) across the warp ends (A,B,&E) with a predetermined tension (I). The tension setting will dictate the modulus of the fabric after finishing. Increasing the tension during weaving will result in a higher modulus. Immediately after the beat up (D) the fabric will begin to contract (E) across the sand roll (F) and finally onto the take up roll (G). At this point the fabric has reached its partial contraction at take up in the PFP recovery level for the non-heat set position.

Figure 5:
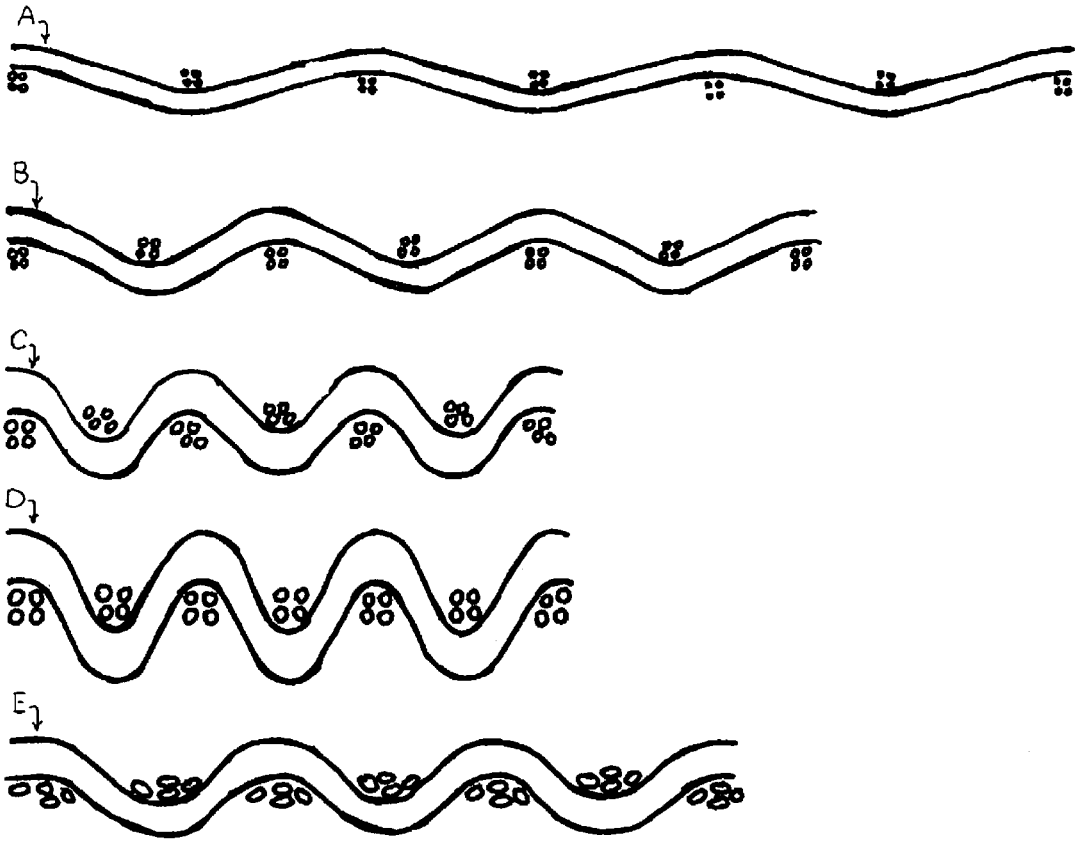
FIG. 5 Representative yarn structures for each of the PFP operations

FIG. 5 illustrates the weft yarn changes during the process from weft insertion. The fill yarn is stretched across the width of the loom (A) and exhibits a partial contraction (B) from the position at the reed to the take up roll. When fabric is removed from the loom and subjected to tension free steam and wash

What is claimed is:

1. A process for manufacturing a weft stretch woven fabric comprising the steps of:

a. providing rigid warp yarn to a weaving loom b. providing fill yarn tensions discs to a weaving loom c. providing fill elastomeric core spun fill yarn to a weaving loom d. controlling the amount of stretch on the elastomeric fill yarn at the tension discs while pulling the fill yarn through the shed during weaving, and e. spacing the warp ends such that partial contraction between the interlacings in the fill direction occurs between the reed and the cut roll during weaving, and f. exposing the partially oriented fabric to steam, and g. washing said fabric with tension free wash equipment, and h. drying said fabric with tension free equipment, and i. subjecting the fully jammed fabric to a tensionless heat and pressure operation, whereby the resulting stretch capacity of the fabric in the fill direction meets or exceeds 90%, the modulus is within the range of 1 to 4, the recovery meets or exceeds the 90%, the growth is less than 10%.

* * * * *